US005509872A

United States Patent [19]

Chen

[11] Patent Number: 5,509,872

[45] Date of Patent: Apr. 23, 1996

[54] TREADMILL HAVING COMPACT MOTOR STRUCTURE

[76] Inventor: Victor Chen, 9F, No. 26, Sec. 2, Min Chuan East Road, Taipei, Taiwan

[21] Appl. No.: 410,282

[22] Filed: Mar. 24, 1995

[51] Int. Cl.[6] ..... A63B 22/02

[52] U.S. Cl. ..... 482/54; 482/51

[58] Field of Search ..... 482/54, 51

[56] References Cited

U.S. PATENT DOCUMENTS 5,100,127 3/1992 Melnick et al. ..... 482/54
5,302,162 4/1994 Pasero ..... 482/54

FOREIGN PATENT DOCUMENTS 2408363 6/1979 France ..... 482/54

*Primary Examiner*—Lynne A. Reichard
*Attorney, Agent, or Firm*—Morton J. Rosenberg; David I. Klein

[57] ABSTRACT

A running machine having a base, an endless belt, two rollers for moving the belt for a user to run on is provided. One of the two rollers has a motor drive assembly incorporated therein for moving the belt. The structure where the motor drive is disposed within a roller minimizes dimensions of the machine, providing convenience for carrying, transporting, and storing the machine. A lubricating device is additionally provided for reducing friction between the belt and the flat plate supporting the belt, thereby lengthening the service life of the machine.

2 Claims, 6 Drawing Sheets

TREADMILL HAVING COMPACT MOTOR STRUCTURE

BACKGROUND OF THE INVENTION

1. Field of the Invention

This invention concerns a running machine. Particularly, this invention is directed to a running machine that is improved, having smaller dimensions than conventional running machines, and a lubricating device for lessening friction of an endless belt against an upholding flat plate, to lengthen service life of the machine.

2. Prior Art

A known conventional running machine shown in FIG. 9 includes a base 11, an endless belt 12 provided on the base 11, a pair of handrails 13 respectively located on two sides of the base 11, a control panel 14 supported between front portions of the handrails 13. The endless belt 12 is installed inside the base 11, extending around two rollers 15, 15. As shown in FIG. 10, a front roller 15 is rotated by a motor 16 connected with gears and a chain, moving the belt 12 incessantly backward, allowing a user standing thereon to run on the belt 12 and remain at the same spot.

However, this known conventional running machine has disadvantages as mentioned below:

1. It has not only a flat frame portion 111 of base 11, but also a swelled-up partition 112 and a compartment 113 extending forward for housing a motor 16 and the roller 15, enlarging dimensions of the machine. The increased size adds cost to the machine and creates inconvenience in carrying, transporting and storing the machine.

2. It has an upholding flat plate located just under the belt to support and keep the belt flat for running, but the moving belt and the flat plate have friction therebetween, owing to weight of a runner, and the friction causes the belt to be subjected to wear and tear, shortening the service life of the machine.

SUMMARY OF THE INVENTION

This invention has been devised to provide a running machine which has one of two rollers equipped with a self rotating structure for moving an endless belt, and thereby minimizing dimensions of the machine.

Another object of the present invention is to add a lubricating device to supply lubricating material to the endless belt, preventing it from wearing.

BRIEF DESCRIPTION OF THE DRAWINGS

The invention will be better understood by reference to the accompanying drawings, wherein.

DESCRIPTION OF THE PREFERRED EMBODIMENTS

Figure 1:
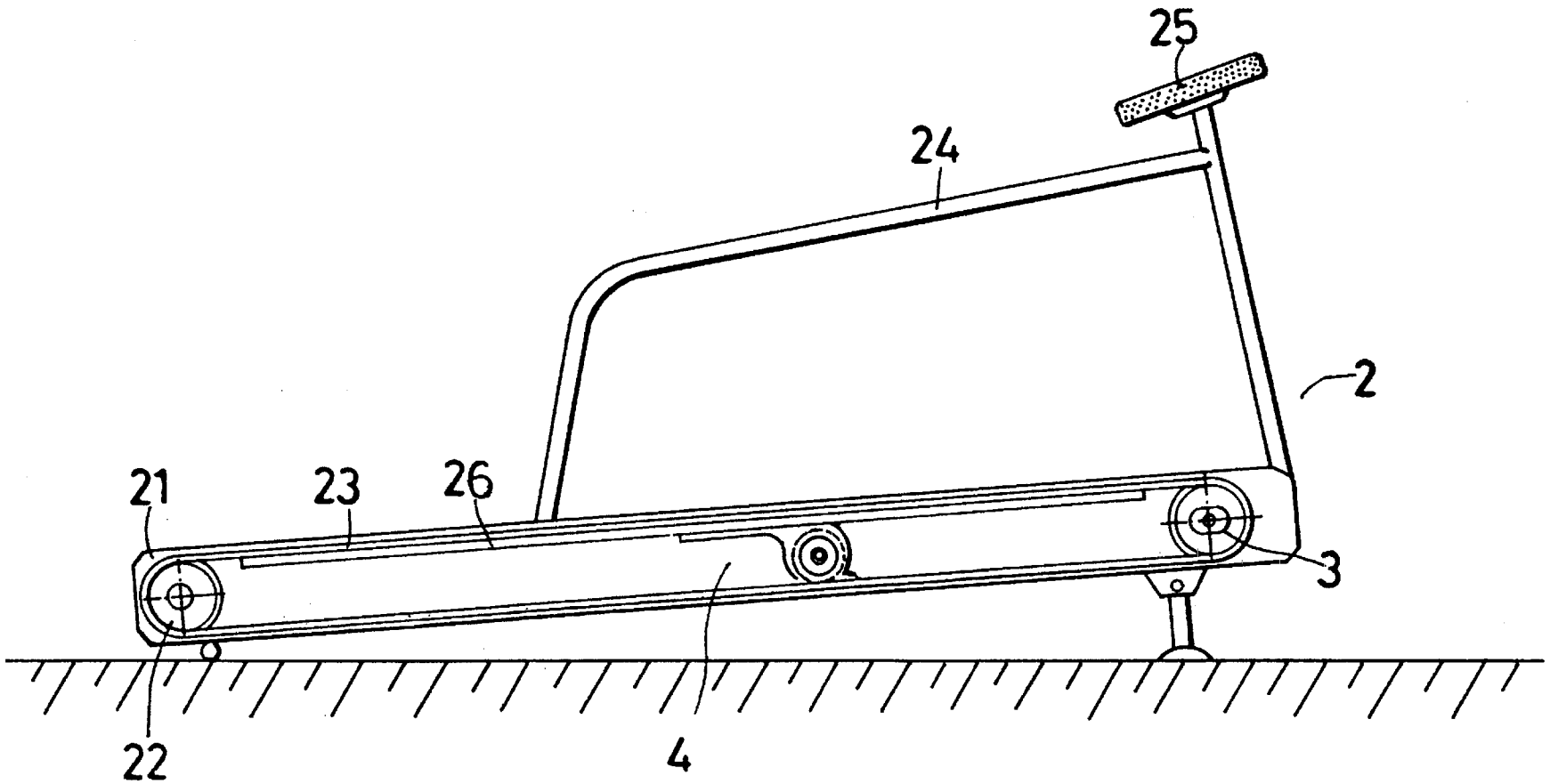
FIG. 1 is a side view of a running machine of the present invention.
Figure 2:
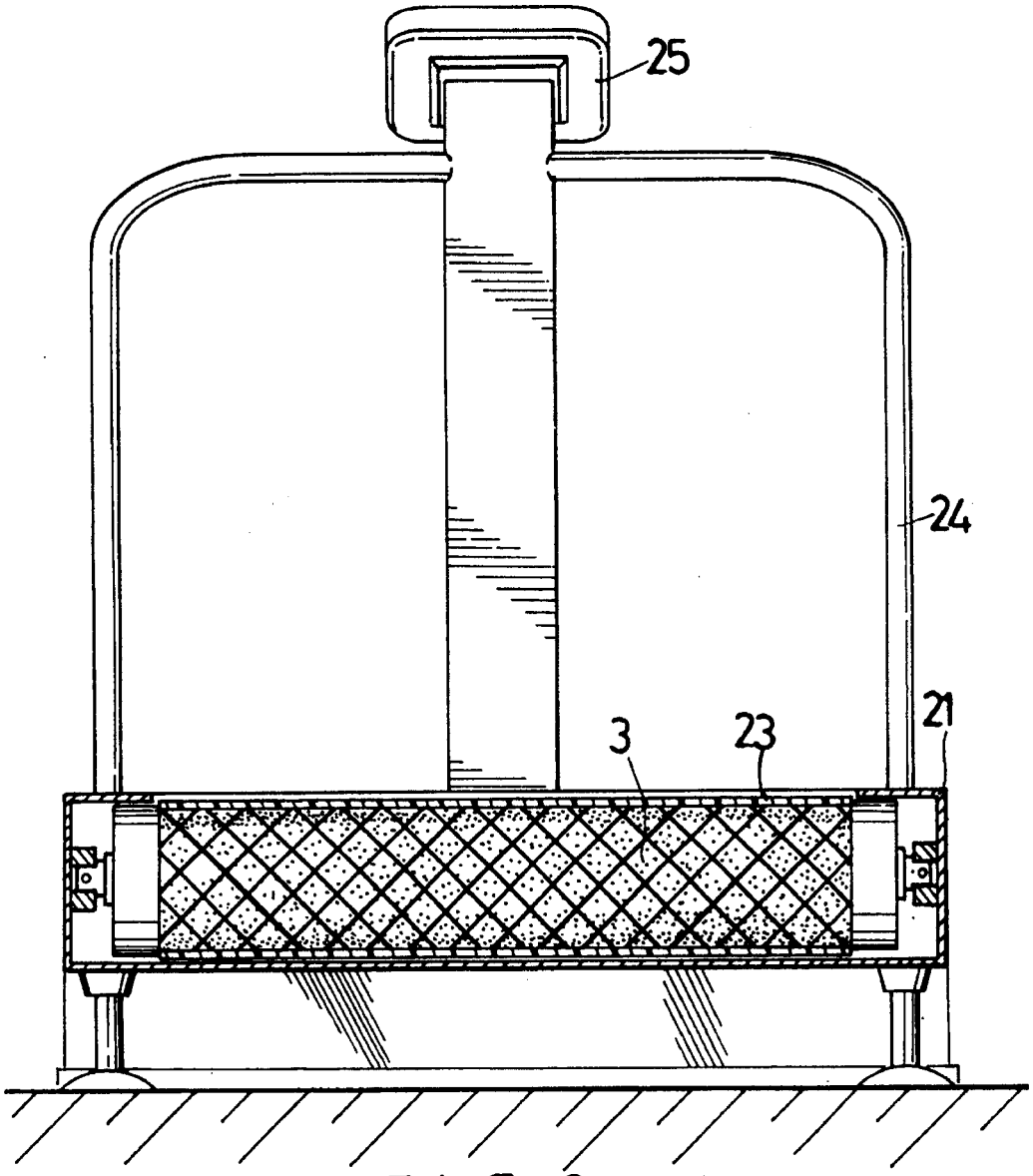
FIG. 2 is a front view of the running machine of the present invention.

A running machine 2 in the present invention, as shown in FIGS. 1 and 2, includes a base 21, two rollers 22, 3, an endless belt 23 provided to extend and move around the two rollers 22, 3, a handrail 24 installed to stand on the base 21 and a control panel 25 fixed on a front upper end of the handrail 24. A flat plate 26 is located just under the endless belt 23 to support the belt 23 in flat condition thereon. The roller 3 is equipped with a self-rotating mechanical structure, and a lubrication device 4 is added in the base 21.

Figure 3:
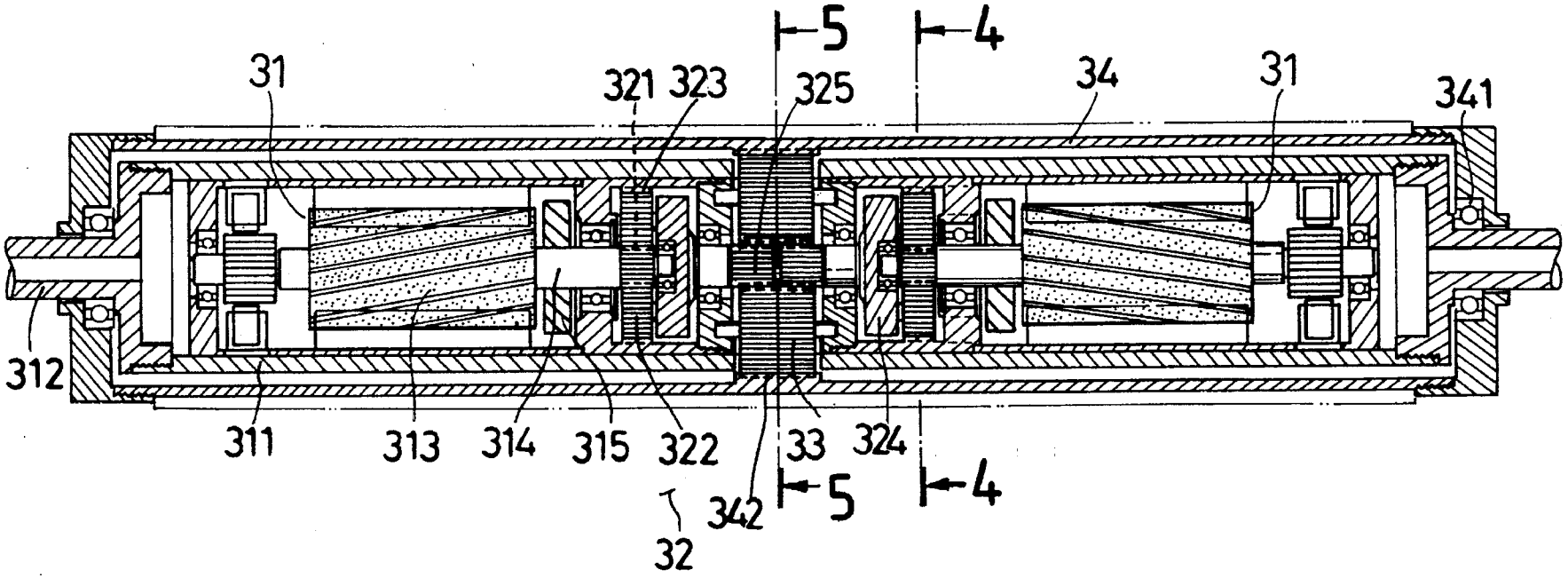
FIG. 3 is a cross-sectional view of a roller in the running machine of the present invention.

The roller 3 includes a self-rotating mechanical structure in its interior, including two motors 31, 31 as shown in FIG. 3. In the interior of roller 3 there is provided, a motor housing 311, a hollow shaft tube 312 respectively provided to extend out of two ends of the motor housing 311. Electric wires for each of the motors 31, 31 extend through the interior of each respective hollow shaft tube 312. A sun and planet gear unit 32 is respectively provided at an inner side of each motor 31. A plurality of transmitting gears 33, preferably three, are provided between the two motors 31, 31, and a rotatable cylinder 34 surrounds the motor housing 311.

Figure 5:
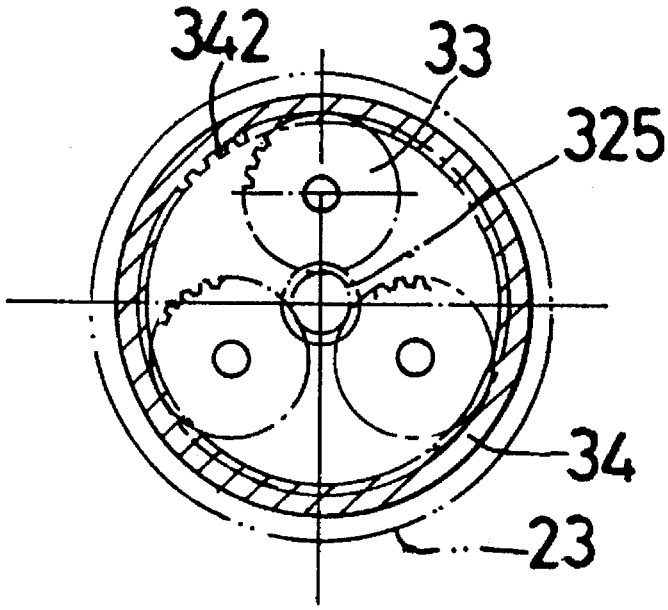
FIG. 5 is a cross-sectional view taken along the section line 5—5 of FIG. 3.
Figure 4:
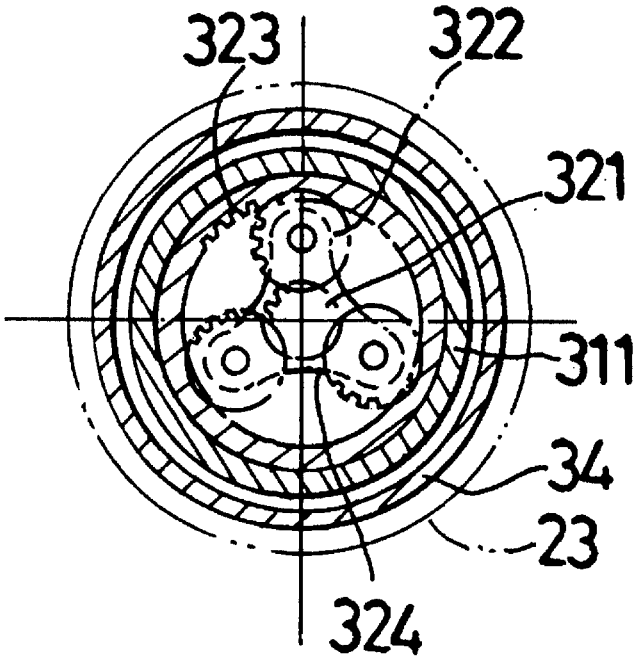
FIG. 4 is a cross-sectional view taken along the section line 4—4 of FIG. 3.

As additionally shown in FIG. 4, each of the two sun and planet gear units 32, 32 have a sun gear 321, three planet gears 322 engaging the sun gear 321 and a toothed ring 323 disposed around and engaged with the three planet gears 322. Each sun gear 321 is connected firmly to a rotor 313 of a respective motor 31. The three planet gears 322 are pivotally connected to a round or triangularly shaped bracket 324, which has a center post 325 extending inwardly. Center post 325 has a toothed portion engaged with all of the transmitting gears 33. Bearings are provided at pivotal connecting locations of the motors 31, 31, enabling the shafts 314, 314 of the motors 31, 31 to rotated smoothly. Each shaft 314 has a leaf 315. The rotatable cylinder 34 receives therein, the motor housing 311 containing the two motors 31, 31 with their respective components. The two ends of rotatable cylinder 34 are respectively and rotatably connected to the hollow shaft tubes 312 by means of a pair of bearings 341 and a center annular toothed surface 342 in an inner wall engaging with the transmitting gears 33, as shown in FIG. 5. Therefore, the rotatable cylinder 34 can be rotated indirectly by the motors 31, 31 through the sun and planet gear units 32, 32, the brackets 324, 324, the center post 325 with the toothed portion and the transmitting gears 33.

Figure 7:
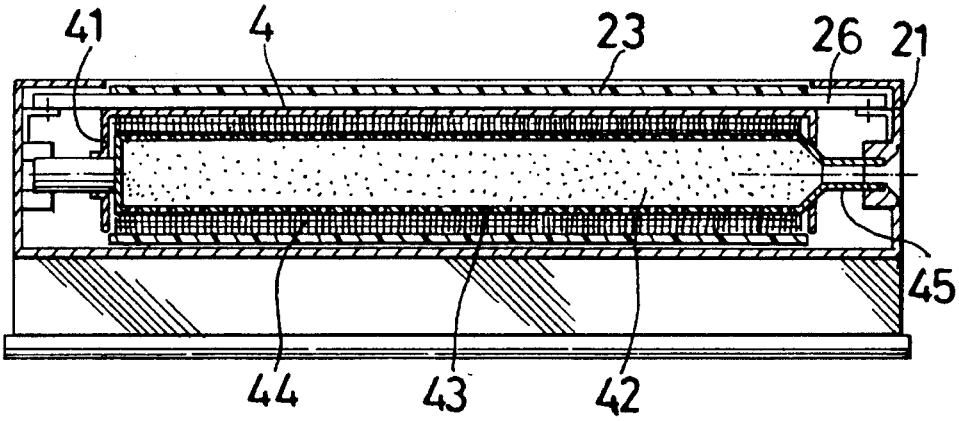
FIG. 7 is a front cross-sectional view of the lubricating device in the running machine in the present invention.
Figure 6:
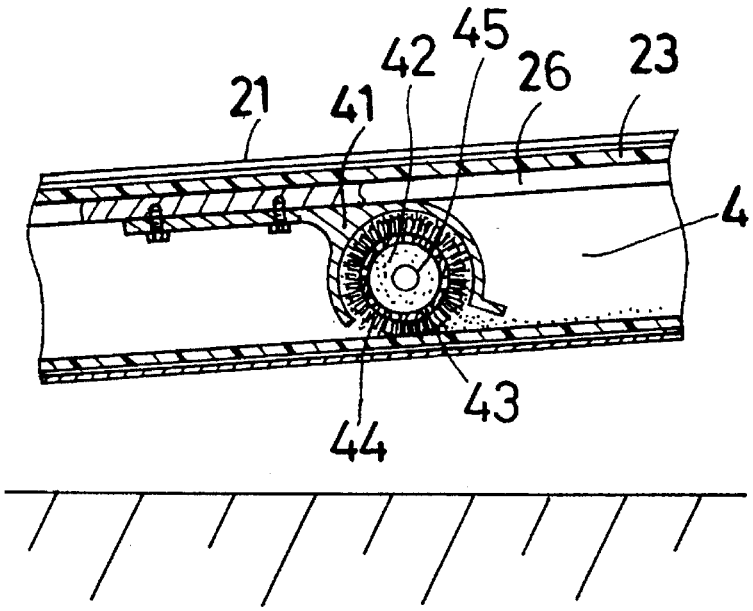
FIG. 6 is a side cross-sectional view of a lubricating device in the running machine in the present invention.
Figure 9:
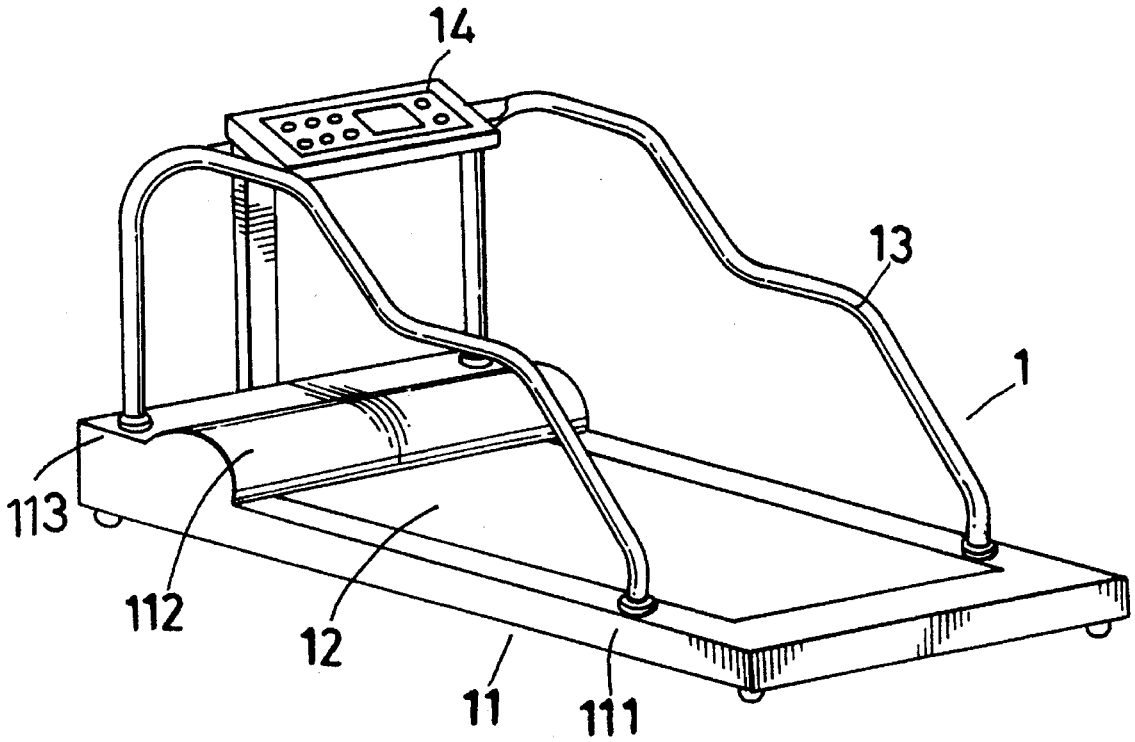
FIG. 9 (PRIOR ART)
FIG. 9 is a perspective view of a known conventional running machine.
Figure 10:
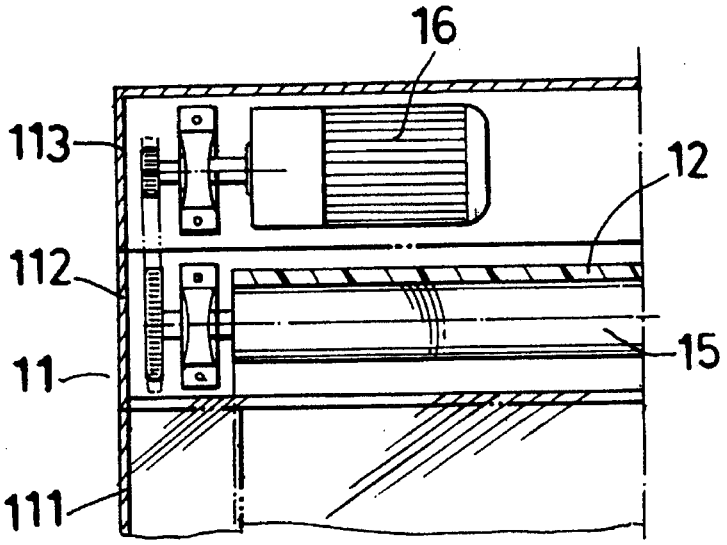
FIG. 10 (PRIOR ART)
FIG. 10 is an enlarged partial view of the known conventional running machine.

Referring to FIGS. 6 and 7, the lubricating device 4 consists of a C-shaped cylinder 41 with a lower lengthwise opening. A hollow lubricating material cylinder 42 is provided having many tiny holes 43 formed in its wall. A cylindrical brush 44 is affixed around the material cylinder 42. The lubricating material cylinder 42 has a hollow shaft 45 respectively extending out from its two ends and pivotally coupled to the base 21. The C-shaped cylinder 41 is secured to the flat plate 26, and the brush 44 has its lengthwise outer surface contacting with the bottom surface of the belt 23. One end of the hollow shaft 45 has an outwardly projected opening, through which lubricating material, such as talc powder, or a wax based oil, may be filled in the hollow material cylinder 42, and fall through the tiny holes 43 to be spread on the brush 44 and then coated on the belt 23 to decrease friction between the belt 23 and the flat plate 26.

Figure 8:
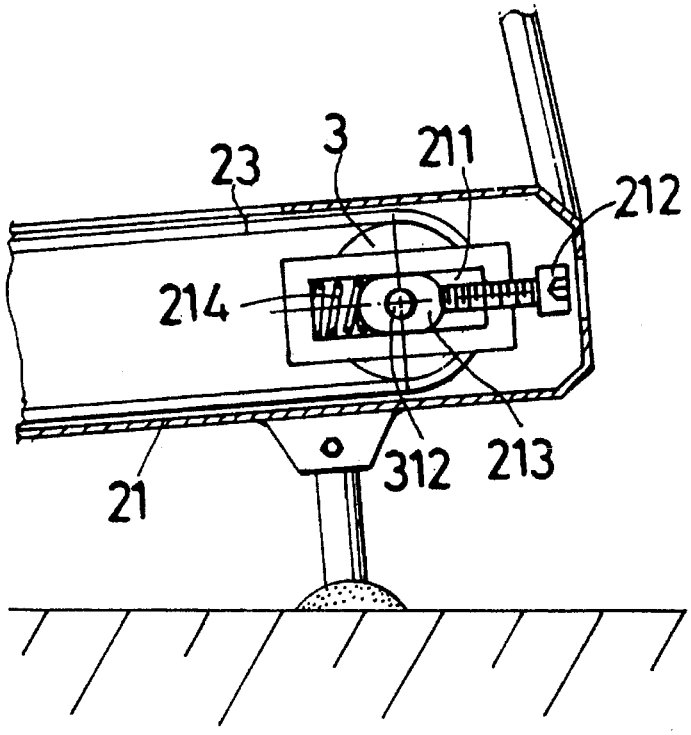
FIG. 8 is a side cross-sectional view of a roller adjuster in the running machine in the present invention.

A roller adjuster is preferably added in the running machine 1 for adjusting tension of the belt 23, as shown in FIG. 8. The adjuster has an adjusting compartment 211 respectively formed in two opposite sides of the base 21. An adjusting screw 212 is threaded through a wall of the compartment 211 to push a slide block 213 disposed within the compartment and biased by a spring 214. The two ends of the two shaft tubes 312 of the roller 3 are secured to the slide blocks 213, 213, so screwing the bolt 212 inward or outward can push or relax the slide block 213, with the roller 3 adjusted in its position and thereby adjusting the tension of the belt 23.

In using this running machine after it is assembled together, when the power is started, the two motors 31, 31 of the roller 3 rotated, with the rotors 313, 313 transmitting rotation via the sun and planet gear units 32, 32, and the toothed surfaces of the center post 325 of the bracket 324. The transmitting gears 33 engage the center annular toothed surface 342 of the rotatable cylinder 34, which is then rotated to let the roller 3 move the belt 23 around the two rollers 3 and 22. Thus, the running machine does not need to leave a hollow space for installing the motors under the base 21, thereby minimizing the dimensions of the running machine 1.

The lubricating device 4 can supply lubricating material such as talc powder, for example, to the belt 23 through the hollow brush cylinder 42. The lubricating material falls through the tiny holes 43 formed in cylinder 42 on to the brush 44, which then brushes the material on the bottom surface of the belt 23 for lowering friction between the belt 23 and the flat plate 26.

It may be realized that this invention has the following advantages from the above-mentioned description:

1. The dimensions of the running machine are much smaller than that of the known conventional one. The dimensions are reduced eliminating the swelled-up chamber housing the motor and its related components, and by installing the motors with their related components within one of the two rollers that move the belt.

2. A lubrication device is added in the base, cutting down friction between the belt and the base, and consequently increasing service life of the machine.

While the preferred embodiments of the invention have been described above, it will be recognized and understood that various modifications may be made therein and the appended claims are intended to cover all such modifications which may fall within the spirit and scope of the invention.

What is claimed is:

1. A running machine, comprising:

a base;

a handrail coupled to said base;

a pair of longitudinally spaced rollers rotatably coupled to said base, one of said rollers being motor driven;

an endless belt extending between said pair of rollers for displacement thereon responsive to rotation of said motor driven roller, said motor driven roller including (1) two motors, each of said motors having an output shaft extending from a rotor thereof, (2) a motor housing provided for containing said two motors and having a respective hollow shaft tube extending respectively from each of two ends of said motor housing, (3) two sets of sun and planet gear units respectively coupled to said two motors, each of said sets of sun and planet gear units being located inward of a respective motor, (4) a plurality of transmitting gears located between said two motors, and (5) a rotatable cylinder surrounding said motor housing, each said sun and planet gear unit including a sun gear, three planet gears engaged with said sun gear, and a ring having an inner toothed surface engaged with said three planet gears, said sun gear being coupled to said rotor output shaft of a respective motor for rotation therewith, said three planet gears having respective shafts connected pivotally to a bracket, said bracket having a center rod extending therefrom, said center rod having a gear portion formed in an outer surface thereof for engagement with said plurality of transmitting gears, said rotatable cylinder surrounding said motor housing and having an annular inner toothed surface disposed at a center portion thereof for engagement with said plurality of transmitting gears, said rotatable cylinder having two ends pivotally connected respectively to said hollow shaft tubes by means of bearings, said motor driven roller being coupled to said base by means of said hollow shaft tubes;

a flat plate member coupled to said base between said pair of rollers for supporting said endless belt thereon; and, means for lubricating an undersurface of said endless belt coupled to said base.

2. A running machine, comprising:

a base;

a handrail coupled to said base;

a pair of longitudinally spaced rollers rotatably coupled to said base, one of said rollers being motor driven;

an endless belt extending between said pair of rollers for displacement thereon responsive to rotation of said motor driven roller;

a flat plate member coupled to said base between said pair of rollers for supporting said endless belt thereon; and, means for lubricating an bottom surface of said endless belt coupled to said base, said lubricating means including (1) a C-shaped cylinder with a lower lengthwise opening, (2) a hollow lubricating material cylinder having a plurality of small holes formed through an outer wall thereof, said lubricating material cylinder having a pair of shaft tubes extending from opposing ends thereof, each of said shaft tubes being pivotally coupled to said base, (3) a cylindrical brush disposed around said lubricating material cylinder, said cylindrical brush contacting said bottom surface of said endless belt, one of said pair of shaft tubes having a bore extending therethrough for passage of lubricating material therethrough for filling an interior space of said lubricating material cylinder, said lubricating material being dispensed through said plurality of small holes of said lubricating material cylinder to be coated on said bottom of said endless belt by said cylindrical brush.

* * * * *